US010245638B2

(12) United States Patent
Lerda

(10) Patent No.: US 10,245,638 B2
(45) Date of Patent: Apr. 2, 2019

(54) DE-CORING VIBRATOR OR PNEUMATIC HAMMER FOR DE-CORING OF FOUNDRY CASTINGS WITH INTEGRATED SENSOR

(71) Applicant: O.M.LER 2000 s.r.l., Bandito—Bra (CN) (IT)

(72) Inventor: Fabrizio Lerda, Bandito—Bra (CN) (IT)

(73) Assignee: O.M.LER 2000 S.R.L., Bandito—Bra (CN) (IT)

( * ) Notice: Subject to any disclaimer, the term of this patent is extended or adjusted under 35 U.S.C. 154(b) by 139 days.

(21) Appl. No.: 15/317,607

(22) PCT Filed: Jun. 8, 2015

(86) PCT No.: PCT/IB2015/054317
§ 371 (c)(1),
(2) Date: Dec. 9, 2016

(87) PCT Pub. No.: WO2015/189757
PCT Pub. Date: Dec. 17, 2015

(65) Prior Publication Data

US 2017/0129007 A1 May 11, 2017

(30) Foreign Application Priority Data

Jun. 9, 2014 (IT) ..... TO2014A0461

(51) Int. Cl.
*B22D 29/00* (2006.01)
*B25D 17/00* (2006.01)
*B25D 9/08* (2006.01)

(52) U.S. Cl.
CPC ..... *B22D 29/005* (2013.01); *B25D 9/08* (2013.01); *B25D 17/00* (2013.01);
(Continued)

(58) Field of Classification Search
CPC ..... B22D 29/04; B22D 29/06; B22D 29/005; B25D 2250/121; B25D 2250/201;
(Continued)

(56) References Cited

U.S. PATENT DOCUMENTS

2005/0000998 A1 1/2005 Grazioli et al.

FOREIGN PATENT DOCUMENTS

FR 2742365 A1 6/1997
WO 2007/006936 A1 1/2007

OTHER PUBLICATIONS

International Search Report and Written Opinion for International Application No. PCT/IB2015/054317, dated Sep. 30, 2015, 10 pages.

*Primary Examiner* — Kevin P Kerns
*Assistant Examiner* — Steven S Ha
(74) *Attorney, Agent, or Firm* — Merchant & Gould P.C.

(57) ABSTRACT

A hammer includes a jacket having an inner chamber; an inlet circuit for the entry of compressed air, and an outlet circuit for the exit of compressed air. The hammer includes a motion mechanism, for generating vibratory motion under the action of compressed air; and a punch or beater, connected to the motion mechanism, for contacting the casting to be de-cored, forming a first end of the hammer. The hammer has a measurement circuit measuring the oscillation frequency of the motion circuit. The measurement circuit includes a sensor for measuring the oscillation frequency of the motion circuit; a processing circuit, enclosed in a protective casing, for receiving electric signals transmitted by the sensor, and a communication line for conducting electric signals from and/or to the measurement circuit. The jacket includes a housing formed in the outer surface of the jacket, such that it incorporating the measurement circuit protective casing.

8 Claims, 9 Drawing Sheets

(52) U.S. Cl.
CPC ..... *B25D 2222/21* (2013.01); *B25D 2222/24* (2013.01); *B25D 2250/121* (2013.01); *B25D 2250/221* (2013.01)

(58) Field of Classification Search
CPC ..... B25D 2250/221; B25D 2222/24; B25D 9/00; B25D 9/06; B25D 9/08; B25D 9/14; B25D 9/26; B25D 9/265; B25D 17/20; B25D 17/22; B25D 17/06
See application file for complete search history.

DE-CORING VIBRATOR OR PNEUMATIC HAMMER FOR DE-CORING OF FOUNDRY CASTINGS WITH INTEGRATED SENSOR

This application is a National Stage Application of International Application No. PCT/IB2015/054317, filed 8 Jun. 2015, which claims benefit of Serial No. TO2014A000461, filed 9 Jun. 2014 in Italy and which applications are incorporated herein by reference. To the extent appropriate, a claim of priority is made to each of the above disclosed applications.

BACKGROUND OF THE INVENTION

The present invention relates to a pneumatic vibrator, also known in the industry as pneumatic hammer, for de-coring of castings made from aluminium, steel and iron alloys.

For the purposes of the present description, the term de-coring refers, in general, to removal of sand material from foundry castings.

Also, for the purposes of the present description, the term castings refers to parts/objects obtained by casting metals into suitable moulds.

Patent WO2007006936 describes a de-coring vibrator or pneumatic hammer.

The vibrator or hammer comprises a jacket comprising holes for inlet and outlet of compressed air. Inside the jacket there is a mechanical assembly consisting of a cylinder in which a piston slides under the action of compressed air. Said piston comes into contact with a punch, which in turn hits the casting to be subjected to de-coring.

Said hammer comprises a connection flange that allows it to be anchored, through fasteners such as socket-head screws, to a de-coring machine.

Said jacket of prior-art hammers is made of cast iron to ensure the desired strength characteristics.

No hammers are known wherein the jacket is made of a material other than cast iron, particularly in the field of high-performance de-coring hammers.

Said jacket is made as one cast monolithic piece.

The use of cast iron significantly increases the total weight of the hammer and requires much milling work, and hence much labour, for making the hollow hole that houses the mechanical assembly.

The use of cast iron also poses some limits as concerns stress resistance, due to the rigidity of the material and the resulting difficult damping of vibrations, which can propagate to the de-coring machine with which the hammer or vibrator is associated.

It is also known that these hammers are to be used in adverse environments where temperatures are very high. In such working conditions, operators must carry out their tasks quickly. It is therefore necessary that de-coring hammers can be easily connected to and removed from the de-coring machine, like the one described in patent EP1995002A2.

The solutions according to the prior art turn out to be difficult to handle, because the various compressed air inlet and outlet circuits are arranged in different areas, thus requiring more work to connect and disconnect the various air circuits.

Also, the hammers must operate at high temperatures, and there is a risk that the mechanisms that generate piston motion upon intake of compressed air might expand, leading to increased friction between the parts, resulting in decreased efficiency of the hammer, and requiring periodic maintenance.

De-coring hammers require high performance in terms of exerted force and piston oscillation frequency, in order to ensure fast and accurate de-coring of metal or alloy castings.

The hammer's performance is mainly checked by constantly monitoring the pulse frequency of the air exiting the cylinder. This type of check is cheap, but suffers from much uncertainty.

Other checking methods also exist, which can monitor the oscillation frequency of the beating mass within the cylinder. This is done by means of a sensor located on the jacket surface. Normally said sensor is connected to a processing circuit external to the hammer.

Said sensor is not protected, and therefore, when removing a hammer, said sensor may suffer damage caused, for example, by shocks.

No hammer currently exist in the art which comprises an integrated sensor that is protected against shocks; as a matter of fact, since the jacket is made as one monolithic piece and has a shape dictated by the standards enforced by the manufacturers of the machines whereto such hammers will have to applied, no protections exist for such sensors.

SUMMARY OF THE INVENTION

The present invention aims at solving one or more of the above-mentioned technical problems by providing an improved de-coring vibrator or hammer which comprises a measurement circuit and a housing for protecting the measurement circuit.

One aspect of the present invention relates to a hammer.

BRIEF DESCRIPTION OF THE DRAWINGS

The features and advantages of the hammer will become apparent from the following description of at least one exemplary and non-limiting embodiment thereof and from the annexed drawings, wherein:

FIG 1A shows the hammer with an associated measurement circuit, and FIG. 1B shows a side view of a de-coring vibrator or hammer according to the present invention;

FIG. 2A is an exploded view and FIG. 2B is a sectional side view along the vertical plane;

FIG. 4A is a sectional view along the plane 4A-4A, which shows the connection between the outlet opening and the exit duct; FIG. 4B is a sectional view along the plane 4B-4B, which shows the exit duct, the housing for the measurement circuit, and the measurement duct; FIG. 4C is a sectional view along the plane 4C-4C, which shows the junction between the exit duct and the exit chamber and the channel for the communication line; FIG. 4D is a view of the rear part of the jacket, wherein the holes for the various circuits are visible.

DETAILED DESCRIPTION

Figure 1A:
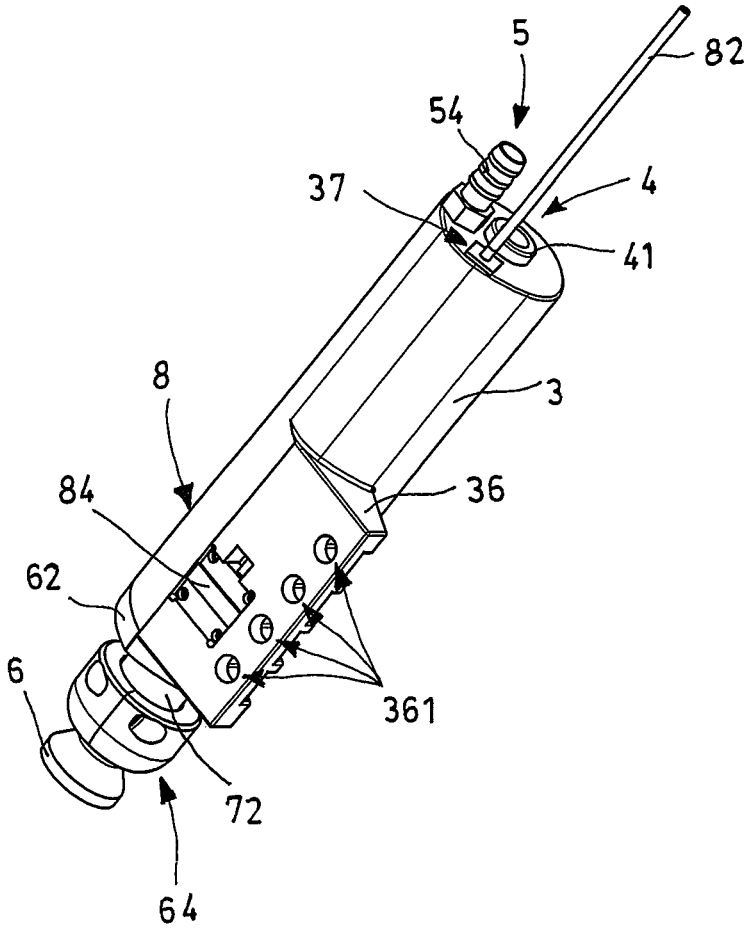
FIGS. 1A and 1B show different views of the hammer or vibrator according to the present invention; in particular.

With reference to the above-listed drawings, pneumatic hammer or de-coring vibrator 2 is suitable for de-coring of foundry castings.

Hammer 2 comprises a jacket 3, in turn comprising an inner chamber 32; an inlet circuit 4 for the entry of compressed air, and an outlet circuit 5 for the exit of compressed air.

Said hammer 2 also comprises, by way of non-limiting example, a connection flange 36 through which hammer 2 can be connected to a de-coring machine. Preferably, said connection flange 36 is comprised in jacket 3 as one piece.

One example of embodiment of the jacket is shown by way of example in FIGS. 3, 4A-4D.

Hammer 2 further comprises a motion mechanism 7, for generating a reciprocating vibratory motion under the action of compressed air.

In an exemplary but non-limiting embodiment, said motion mechanism is such that it allows a linear motion along an axis "Z", which is preferably the longitudinal axis of hammer 2 itself, between a retracted position and a working position, under the action of compressed air.

Figure 2A:
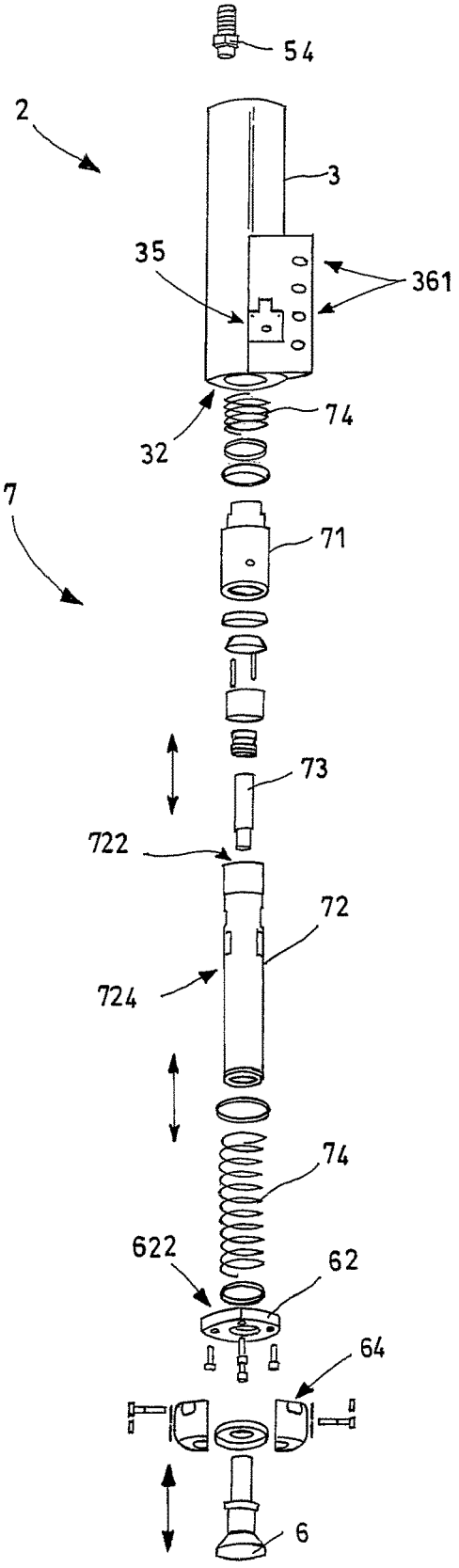
FIGS. 2A and 2B show the hammer or vibrator of FIG. 1; in particular.
Figure 2B:
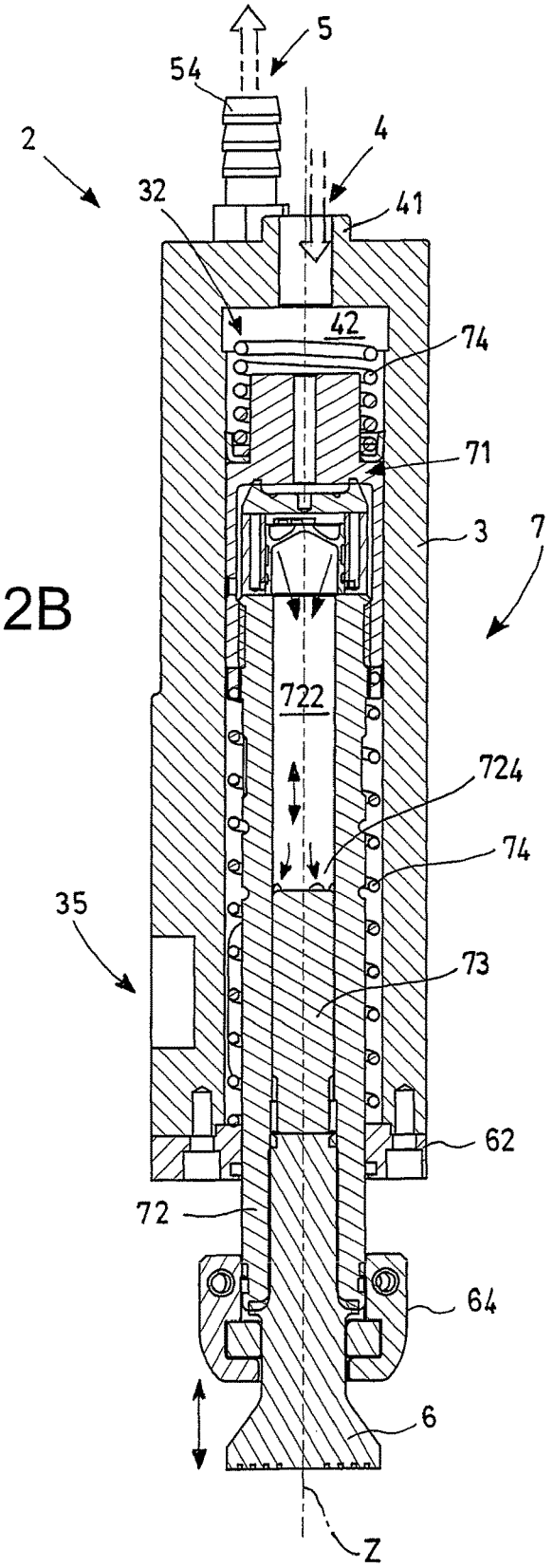

Motion mechanism 7 is arranged within inner chamber 32 of jacket 3, as can be seen, for example, in the exemplary embodiment of FIGS. 2A-2B.

Hammer or vibrator 2 further comprises a punch or beater 6, connected to said motion mechanism 7, for coming into contact with the casting to be subjected to de-coring. Said punch or beater 6 constitutes a first end of hammer 2.

The hammer according to the present invention further comprises a measurement circuit 8 for measuring the oscillation frequency of motion circuit 7.

Measurement circuit 8 comprises at least one sensor for measuring the oscillation frequency of motion circuit 7; a processing circuit, enclosed in a protection casing 84, for receiving the electric signals transmitted by said at least one sensor, and a communication line 82 for conducting electric signal from and/or to said measurement circuit 8.

Jacket 3 comprises a housing 35 formed in the outer surface of jacket 3, such that it incorporates within its own outer profile protection casing 84 of measurement circuit 8.

Said motion mechanism 7 is adapted to impart a vibratory motion to punch or beater 6, for the purpose of achieving an optimal de-coring effect.

Said motion mechanism 7 is also adapted to move said punch 6 at least linearly along said axis "Z".

Hammer or vibrator 2 further comprises at least one closing element 62, such that motion mechanism 7 is held within inner chamber 32 of jacket 3; and at least one bushing 64 for preserving the connection between punch or beater 6 and said motion mechanism 7.

Said closing element 62 is preferably a plate to be secured to a first end of jacket 3. Said closing element 62 comprises a through hole 622. In one exemplary but non-limiting embodiment, closing element 62 comprises a plurality of small holes or nozzles (not shown). Said holes are adapted to direct an air jet towards punch or beater 6. The air, coming from a dedicated supply, flows through the holes and removes sand and dirt from the hammer, thereby preventing early deterioration of the latter. Said holes or nozzles are preferably arranged around a circumference concentrical to hole 622. Also, said holes or nozzles may be so shaped as to generate an air jet which is angled relative to said axis "Z", for the purpose of channeling the air towards cylinder 72. Hammer 2 comprising a closing element as described is particularly suited for application to rotary de-coring machines.

By way of non-limiting example, said motion mechanism 7 comprises a head 71 for appropriately directing an air flow, a cylinder 72, and a beating mass 73 adapted to slide within an inner cavity 722 of the same cylinder 72. The motion mechanism comprises elastic elements 74, such as, for example, coil springs.

Said elastic elements 74 are adapted to exert a force on motion mechanism 7, such that said motion mechanism 7 is held in either one of the retracted position and a working position, depending on the action of compressed air, as is known to a man skilled in the art. Said punch or beater 6 is connected to a first end of said cylinder 72.

At said connection, at least one bushing 64 is comprised.

Hole 622 comprised in closing element 62 is crossed by said cylinder 72. Said cylinder 72, as it moves along said axis "Z" for switching between the retracted position and the working position, slides in said hole 722. The shape of said hole 622 is such that it prevents any undesired inclination of the cylinder relative to said axis "Z" of cylinder 72 when hammer 2 is in operation.

Said head 71, located at a second end of said cylinder 72, is adapted to direct a part of the air into inner cavity 722 of cylinder 72, so as to put in motion said beating mass 73. The motion of the beating mass within cylinder 72 generates a vibratory motion of cylinder 72. Said vibratory motion is transferred to punch or beater 6 as known to a man skilled in the art.

The air directed into inner chamber 32 of jacket 3 for moving motion mechanism 7 is exhausted by means of outlet circuit 5 as it exits inner chamber 32 of jacket 3 through an outlet opening 51 comprised in said outlet circuit 5.

The air that has entered inner cavity 722 of cylinder 72 comes out of the same inner cavity 722 through exhaust through holes 724 formed in said cylinder 72.

Motion mechanism 7 will not be described any further herein because it is known to those skilled in the art.

In the preferred embodiment, said bushing 64 is made up of two assemblable half-shells, e.g. as shown in 2A. Also, said bushing is made of polyester rubber material, e.g. adiprene.

As aforementioned, hammer 2 comprises a measurement circuit 8 for measuring the oscillation frequency of motion circuit 7.

Said measurement circuit 8 is integrated into hammer 2 as an assembly. In particular, said circuit is positioned in a suitable housing, so that it cannot be damaged. The present solution provides a more accurate measurement by measuring the oscillation frequency of the motion mechanism, while still ensuring adequate protection of the measurement device, which is associated with the hammer itself, not with the air recovery circuit as in the prior art.

Describing the construction more in detail, said jacket 3 is made as one monolithic piece, preferably including said connection flange 36. Said jacket is made by using a mould or chill casting process.

In hammer 2 according to the present invention, jacket 3 is made from an aluminium alloy.

Said aluminium alloy has a specific weight higher than or equal to 2.60 $kg/dm^3$. Said aluminium alloy also has a specific weight lower than or equal to 2.85 $kg/dm^3$.

This distinctive specific weight range of the alloy according to the present invention is much lower than the value of approx. 7 $kg/dm^3$ which is typical of cast iron, the latter being the material used in the prior art for making said jacket. This alloy allows a reduction by about two thirds of the total weight of hammer 2.

Said alloy has a percentage in weight of aluminium of at least 83%.

Said alloy has a percentage in weight of aluminium lower than 98%.

Preferably, the alloy comprises at least one alkaline earth chemical element, e.g. magnesium.

Also, the alloy preferably comprises a semiconductor chemical element, e.g. silicon.

In the preferred embodiment, in the aluminium alloy employed for making jacket 3 according to the present invention, silicon is used as a semiconductor material and magnesium is used as an alkaline earth element.

In one exemplary embodiment of the aluminium alloy, the percentage of silicon is comprised between 4% and 8% and the percentage of magnesium is comprised between 0.2% and 0.8%.

The aluminium alloy used for making jacket 3 according to the present invention may comprise one or more metallic elements, e.g. copper, manganese, titanium and zinc.

The percentage of the various components may vary depending on physical characteristics, such as the specific weight to be obtained. By way of non-limiting example, a reduction in silicon content will reduce the specific weight of the alloy. On the contrary, the addition of metals to the alloy will increase the specific weight thereof.

In the preferred but non-limiting embodiment, the alloy is composed as follows:

Aluminium between 91.87% and 93.1%;

Silicon between 6.5% and 7.5%;

Magnesium between 0.3% and 0.45%;

Titanium between 0.1% and 0.18%.

The specific weight of the alloy thus obtained is 2.66 $kg/dm^3$.

In alternative embodiments, copper is added in percentages comprised between 1% and 1.5%.

In general, hammer or vibrator 2 according to the present invention comprises a jacket 3, which is preferably made of said aluminium alloy, or may be made of cast iron just like traditional prior-art jackets, without however departing from the protection scope of the present invention. Said jacket 3, as aforementioned, comprises an inlet circuit 4 and an outlet circuit 5.

In one exemplary embodiment, said jacket 3 has a substantially cylindrical shape. The embodiment shown in the annexed drawings employs, by way of example, a jacket having a rhomboidal section.

Inlet circuit 4 comprises an inlet connector 41 allowing the connection of hammer 2 to a compressed air circuit.

Said inlet connector 41 is located at a second end of hammer 2, and of jacket 3, opposite to the end where punch or beater 6 is located.

Said outlet circuit 5 comprises an outlet connector 54 for connecting hammer 2 to an air recovery circuit.

In the preferred but non-limiting embodiment of hammer 2 according to the present invention, said outlet connector 54 is located at the second end of hammer 2 in proximity to inlet connector 41.

Outlet circuit 5 comprises: an outlet opening 51 formed in cylinder 3, through which the air comes out upon activation of motion mechanism 7, and an exit duct 52 extending from said outlet opening 51 up to said second end of hammer 2, in particular to the second end of jacket 3. Said outlet opening 51 and exit duct 52 are formed in jacket 3 itself, in particular in the edges of jacket 3 that define inner chamber 32. Said inner chamber 32 preferably has a circular section, as can be seen, for example, in FIGS. 2A-2B, 4A and 4B.

In particular, said exit duct 52 is incorporated into jacket 3 in an inaccessible manner.

Preferably, said exit duct 52 is so shaped as to encircle at least partially, with respect to the plane perpendicular to its longitudinal extension, inner chamber 32 of jacket 3, thus acting as a cooling circuit for jacket and/or for motion mechanism 7 arranged in said inner chamber 32 of jacket 3.

In general, said exit duct may be so shaped as to follow, at least partially, the curvature of the inner chamber, with respect to the plane perpendicular to its longitudinal extension.

In one possible embodiment, the cross-section of said exit duct 52 is shaped like a portion of circular crown. One embodiment of the shape of said exit duct 52 is shown in FIGS. 4A-4D.

In one exemplary embodiment, said exit duct may have a circular or elliptical cross-section, or any shape suitable for encircling, at least partially, the inner chamber of jacket 3.

In a further embodiment (not shown), said exit duct is a circular hole that only works, for example, as an exit duct, which can however be still integrated into jacket 3.

Preferably, outlet circuit 5 comprises: a first chamber 510 for placing outlet opening 51 in fluidic communication with exit duct 52 by joining them together. Said first chamber 510 may be a closed chamber or a recess formed in proximity to outlet opening 51, such that it links said outlet opening 51 to said exit duct 52. In one exemplary and non-limiting embodiment, said first chamber is a tapered duct portion for linking the outlet opening to said exit duct.

Outlet circuit 5 further comprises an exit chamber 53 that puts exit duct 52 in fluidic communication with outlet connector 54, e.g. by joining them. Said chamber allows linking said exit duct 52 to outlet connector 54. In the preferred embodiment, said exit chamber has at least one circular portion that allows fastening, e.g. by means of a thread, the outlet connector to outlet circuit 5. In an exemplary but non-limiting embodiment, said exit chamber 53 is a tapered duct portion that links said exit duct to outlet connector 54.

Said outlet connector 54 is preferably a discrete element, connected to a hole formed in jacket 3, e.g. by means of a thread.

FIG. 2B shows one exemplary embodiment of motion mechanism 7, wherein a man skilled in the art can intuitively appreciate the compressed air flows which enter through inlet circuit 4 in order to move hammer 2 and exit through said outlet circuit 5.

As can be clearly seen, the compressed air supplied to inlet connector 41 enters an intake chamber 42. Said intake chamber has a variable volume, which depends on the motion of motion mechanism 7 within inner chamber 32 of jacket 3 between the retracted position and the working position.

As it enters said intake chamber 42, the compressed air exerts a thrust on motion mechanism 7, switching it from the retracted position to the working position.

The same compressed air is introduced into inner chamber 722 of cylinder 72 through intake ducts comprised in said head 71, thus causing the beating mass to oscillate within cylinder 72, as known to those skilled in the art.

The oscillation of motion mechanism 7, and in particular of beating mass 73, causes the air to be directed towards outlet circuit 5.

In particular, there is an outlet opening 51 that allows the compressed air to come out of inner chamber 32 of jacket 3.

The air guided by outlet opening 51 is brought, through the exit duct, towards an air recovery circuit.

Between an outlet connector, which allows the hammer to be connected to an air recovery circuit (not shown), and exit duct 52 there is said exit chamber 53.

As mentioned above, in a preferred but non-limiting embodiment hammer 2 according to the present invention comprises a measurement circuit 8 for measuring the oscillation frequency of motion mechanism 7.

Said measurement circuit 8 comprises at least one sensor adapted to measure the oscillation frequency of motion mechanism 7.

In one possible embodiment, said measurement circuit 8 is adapted to measure the pressure inside inner chamber 32 of jacket 3.

In a preferred embodiment, said measurement circuit 8 is adapted to detect the sliding motion of beating mass 73 in cylinder 72. This measurement can be taken directly by means of a position or slide sensor. This measurement can also be taken indirectly by means of a sensor capable of detecting the pressure variations caused by the motion of beating mass 73 in cylinder 72. The preferred embodiment employs an extensometric sensor capable of detecting the deformation of an electric conductor caused by an alternate air flow ensuing from the sliding motion of beating mass 73 in cylinder 72. One possible embodiment of said measurement circuit 8, and of the method for acquiring the measured data, is described, for example, in Italian patent application RN2005A000024.

Said measurement circuit 8 comprises a processing circuit (not shown), enclosed in a protection casing 84, for receiving the electric signals transmitted by said at least one sensor, and a communication line 82 for conducting the electric signals from and/or to said measurement circuit 8.

Said communication line 82 allows said measurement circuit 8 to be connected to an external control circuit (not shown), to which it can communicate the obtained data.

The hammer according to the present invention comprises a channel 37, formed in jacket 3 and leading to the second end of hammer 2, in particular to the second end of said jacket 3, near inlet connector 41.

Figure 4A:
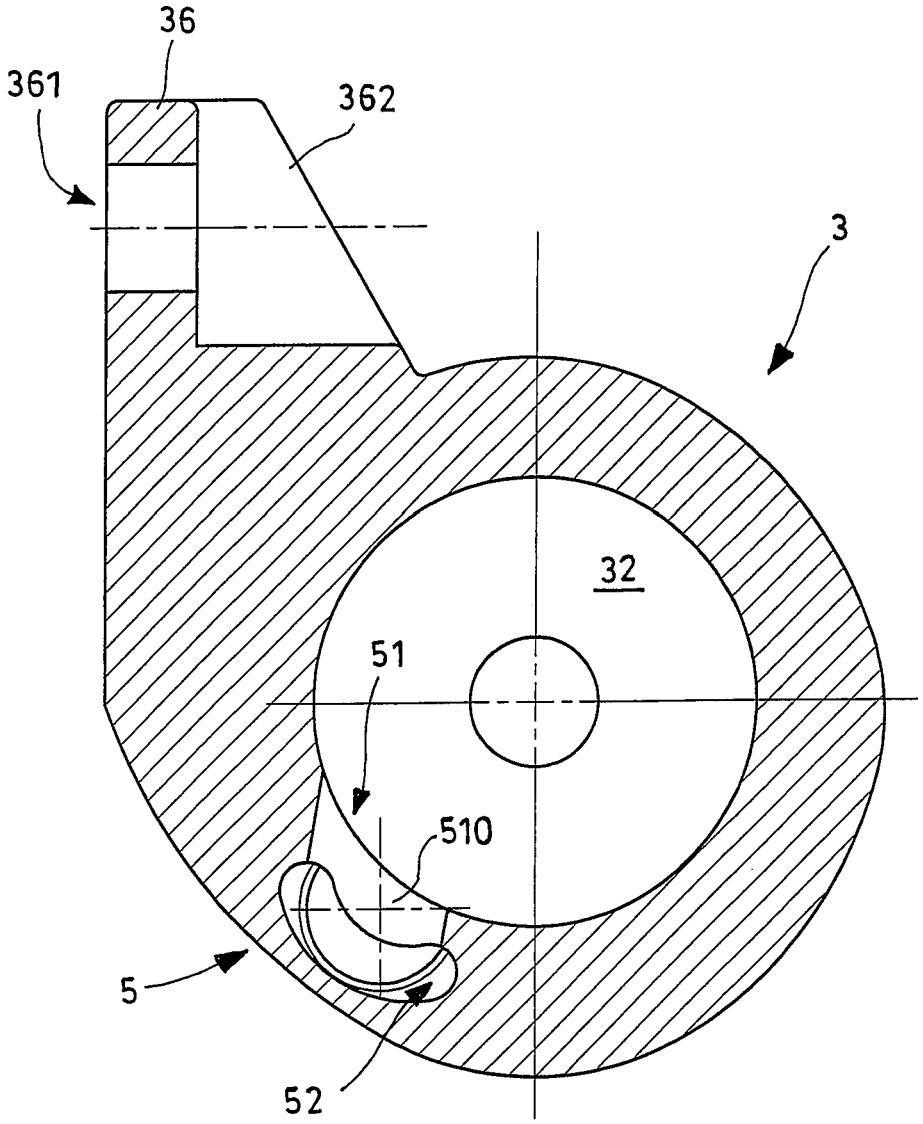
FIGS. 4A-4D show some rear views of the jacket of FIG. 3; in particular.
Figure 4B:
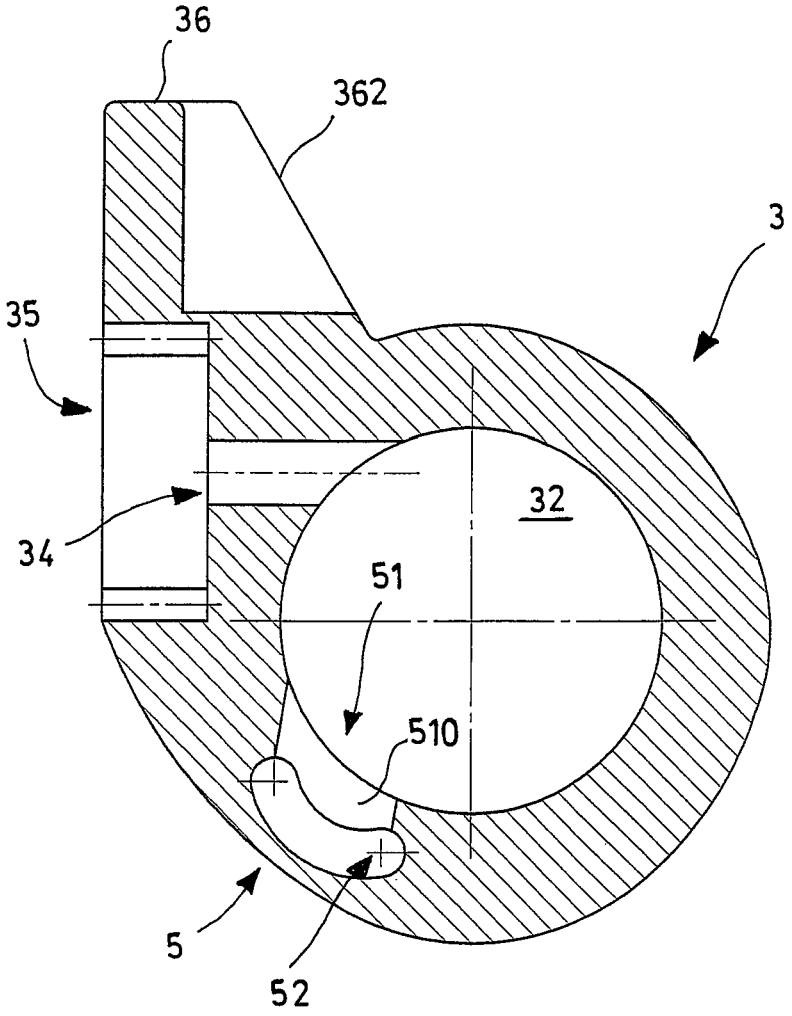
Figure 4C:
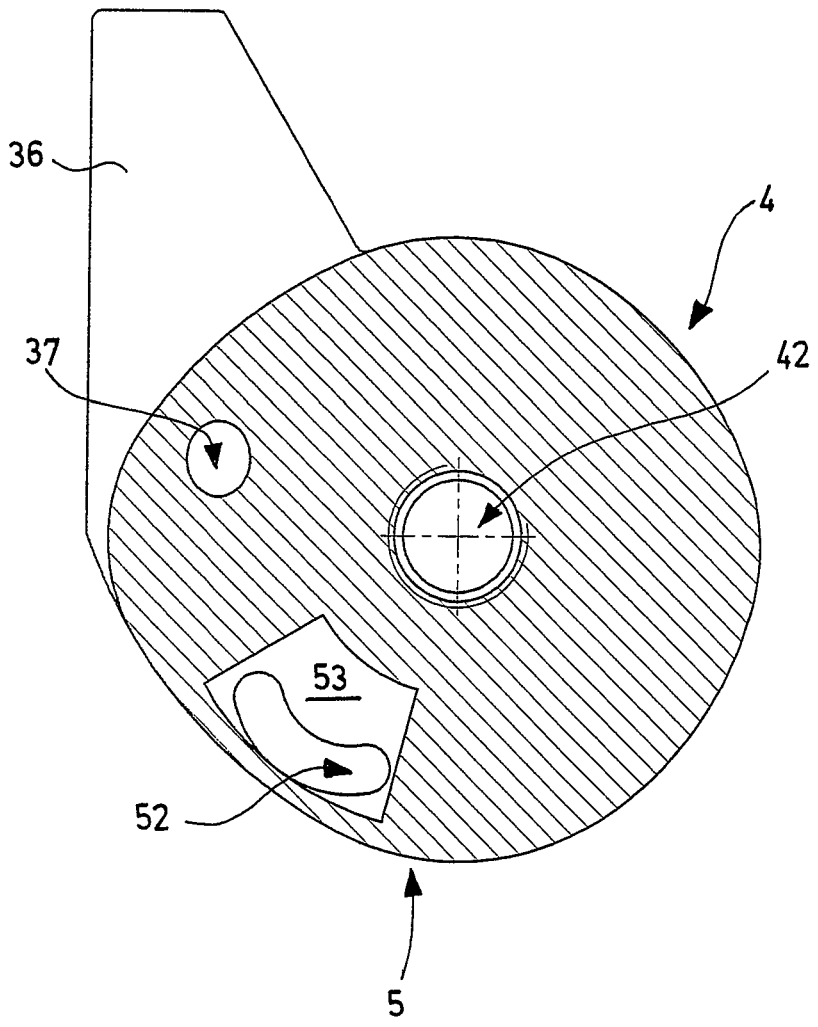
Figure 4D:
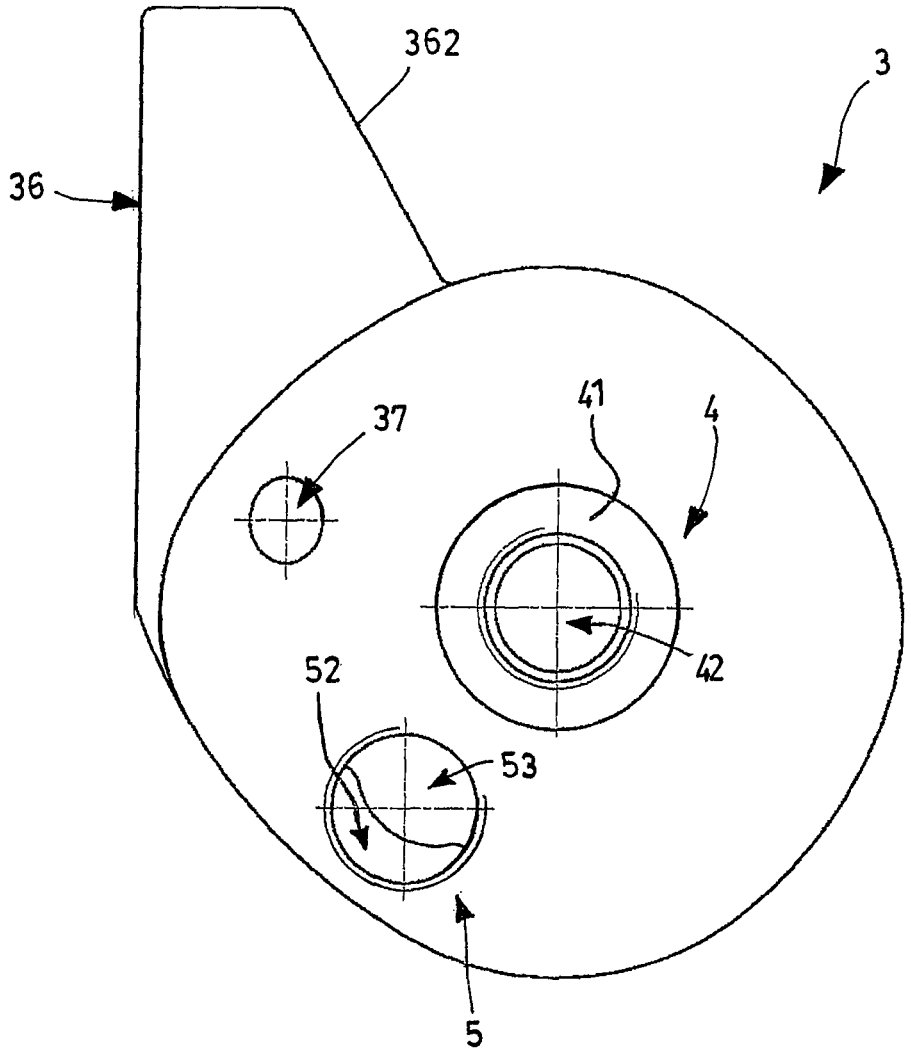

In the exemplary but non-limiting embodiment illustrated herein, said channel 37 has a substantially circular section, as can be seen, for example, in FIGS. 4C and 4D.

Said communication line 82 can be placed in said channel 37, for the purpose of keeping the whole connection part of the hammer concentrated at the second end thereof. Said channel 37 is preferably incorporated into the walls that define the inner chamber of jacket 3, in an inaccessible manner.

Such an embodiment of jacket 3 allows concentrating the part for connecting the hammer to electric or pneumatic circuits by placing it at the second end of hammer 2. Even more preferably, the connection part is arranged at the base of the cylindrical structure of jacket 3. Preferably, the shape and structure of the various channels, chambers and ducts formed in said jacket 3 are such that they can be easily obtained by turning or milling.

Furthermore, the use of an aluminium alloy allows making said channels, chambers and ducts in significantly shorter times compared to the machining required by cast-iron jackets.

As aforementioned, jacket 3 of hammer 2 according to the present invention comprises a housing 35 formed in the outer surface of jacket 3 itself, the outer profile thereof enclosing measurement circuit 8, in particular protection casing 84.

The shape of said housing 35 is complementary to the shape of the external protection casing 84, so that the latter can be accommodated therein.

In said housing 35 there is at least one fastening portion that allows securing measurement circuit 8 to hammer 2, in particular to jacket 3.

Measurement circuit 8, and in particular external protection casing 84, are fastened to the hammer by means of fasteners such as screws or bolts.

Said housing 35 is formed in that portion of cylinder 3 from which connection flange 36 extends.

Even more preferably, said housing 35 is formed at the initial flat portion of connection flange 36, where the same flange 36 begins to emerge from the profile of jacket 3, as can be seen, for example, in FIGS. 1A, 1B, 2A, 3 and 4B.

Preferably, from said housing 35 channel 37 starts, into which communication line 82 for measurement circuit 8 can be laid.

Said channel 37 is even more preferably located in proximity to the outer perimeter of the base of the cylindrical structure of jacket 3, in particular near the region where flange 36 begins to emerge from the profile of jacket 3.

Furthermore, at said housing 35 jacket 3 comprises a measurement duct 34 through which measurement circuit 8 can take the measurement for determining the oscillation frequency of motion mechanism 7.

Said measurement duct 34 is preferably a hole, more preferably a hole with a circular cross-section.

Said duct 34 puts the outside environment in communication with inner chamber 32 of jacket 3, as can be seen, for example, in FIG. 4B. At said measurement duct 34 said sensor of measurement circuit 8 is arranged.

In the preferred embodiment, said sensor is positioned above said measurement duct 34, more preferably where channel 34 departs from said housing 35.

In particular, said sensor is arranged on the bottom face of protection casing 84 that encloses the processing circuit, in a suitable aperture through which the air jet generated by the oscillation of beating mass 73 in cylinder 72 can act upon the sensor.

Figure 1B:
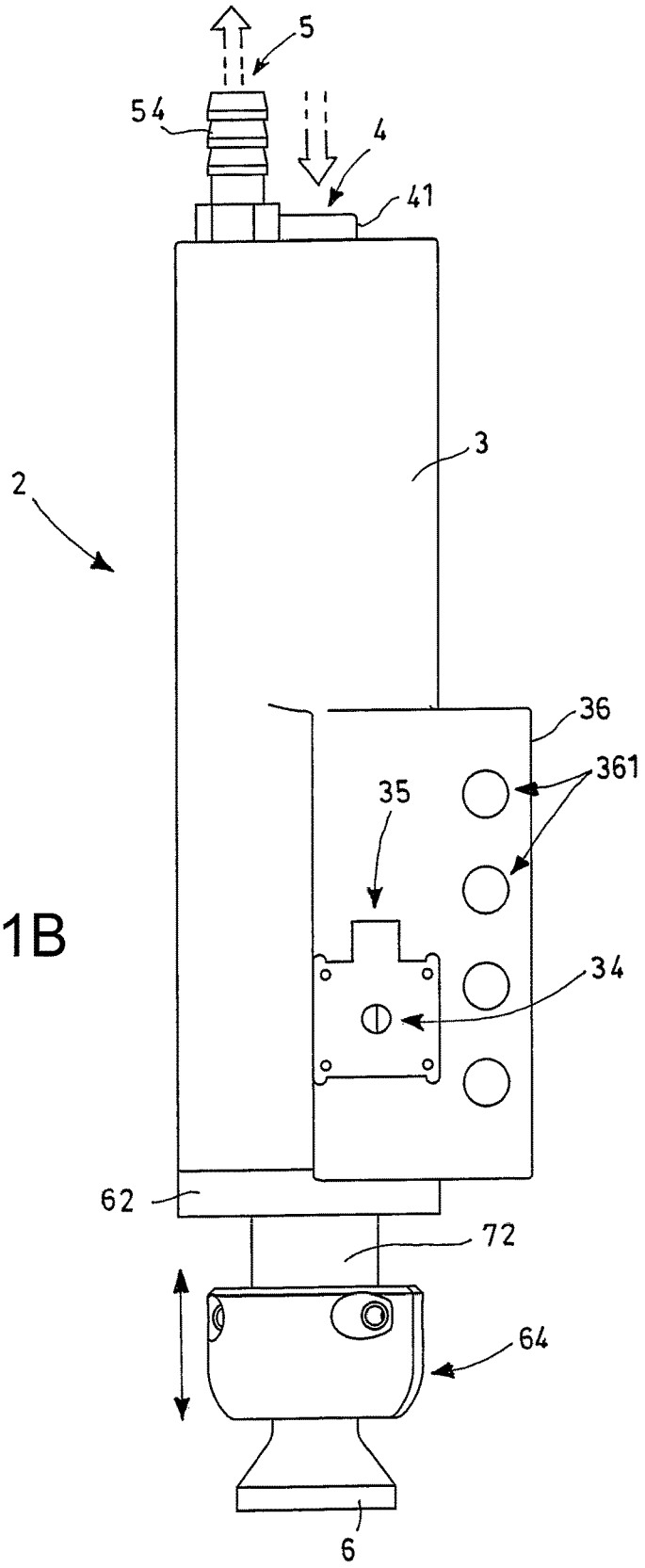
Figure 3:
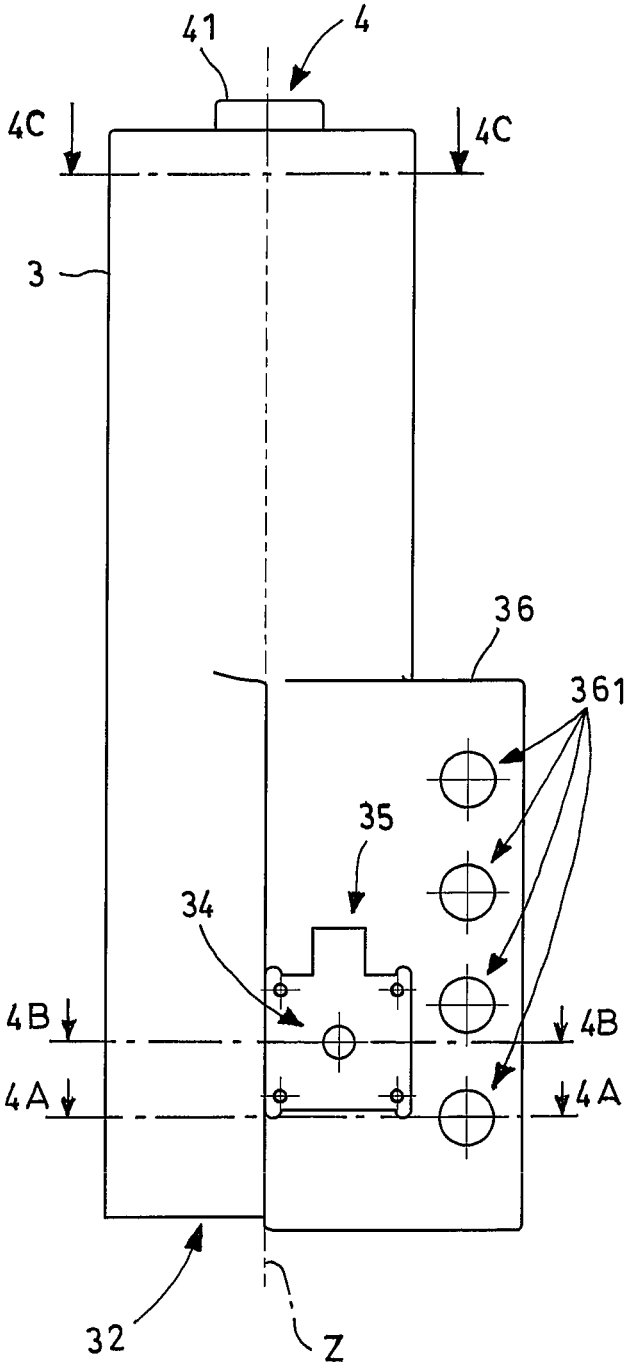
FIG. 3 shows a side view of a jacket of the hammer or vibrator of FIGS. 2A-2B.

Said measurement duct 34 is preferably formed in the central region of housing 35, as shown by way of example in FIGS. 1B, 3.

The shape of said housing is complementary to said protection casing 84 of measurement circuit 8.

In the preferred embodiment, said housing 35 has a parallelepiped shape, in particular suitable for receiving protection casing 84 of measurement circuit 8, which also has a parallelepiped profile.

Said housing 35 is adapted to envelop at least five faces of protection casing 84 of measurement circuit 8.

Said housing 35 is shaped in a manner such that it can be directly created with the mould or chill used for making entire jacket 3. As an alternative, it may be machined by milling.

The hammer according to the present invention, since it employs an aluminium alloy, allows speeding up the making of said housing, since less labour is needed.

As aforementioned, in the illustrated embodiment said jacket 3 has a substantially cylindrical shape with a rhomboidal section, as can be seen, for example, in FIGS. 4A-4D.

The particular aluminium alloy described above provides the entire structure of jacket 3 with more stress resistance and better damping of undesired vibrations.

Since the pneumatic and electric connections are all situated in the rear part of the hammer, at the second end thereof, in particular at the second end of jacket 3, the hammer according to the present invention offers good handling characteristics.

Because communication line 82, e.g. an electric cable, can be connected to an extension cable by means of a connector, the measurement circuit can be installed and removed quickly from the hammer 2 according to the present invention.

Furthermore, air outlet circuit 5 has been designed for ensuring better cooling of the internal components, in particular of motion mechanism 7.

One particularly important aspect of the present invention concerns measurement circuit 8, and in particular the sensor, preferably an extensometric sensor, which allows detecting the operating frequency of hammer 2, in particular the oscillation frequency of the beating mass. In hammer 2 according to the present invention, said measurement circuit 8 is arranged in a suitable housing for protecting it from shocks and preventing it from falling.

Said connection flange 36 comprises a plurality of holes 361, through which fasteners such as socket-head screws can be inserted for removably securing the hammer to a de-coring machine.

Said connection flange 36 comprises partition elements 362 that separate the fastening areas. Such partition elements 362 are also shaped in such a way as to abut against heads of fasteners such as screws and bolts compliant with the ISO standards.

Hammer or vibrator 2 according to the present invention is very efficient and robust thanks to structures and materials specifically designed and analyzed for the stresses involved.

REFERENCE NUMERALS

De-coring vibrator or hammer 2
Jacket 3
Inner chamber 32
Measurement duct 34
Housing (sensor) 35
Connection flange 36
Connection holes 361
Partition elements 362
Channel (sensor cable) 37
Inlet circuit 4
Inlet connector 41
Intake chamber 42
Outlet circuit 5
Outlet opening 51
First chamber 510
Exit duct 52
Exit chamber 53
Outlet connector 54
Punch or beater 6
Closing element 62
Hole 622
Bushing 64
Motion mechanism 7
Head 71
Cylinder 72
Inner cavity 722
Exhaust holes 724
Elastic elements 74
Beating mass 73
Measurement circuit 8
Communication line 82
Protection casing 84

The invention claimed is:

1. A pneumatic hammer for de-coring of foundry castings; the hammer comprising:
- a jacket comprising:
  - an inner chamber;
  - an inlet circuit for entry of compressed air; and
  - an outlet circuit for exit of said compressed air;
- a motion mechanism, for generating a vibratory motion under action of said compressed air;
- a punch or beater, connected to said motion mechanism, for coming into contact with a casting to be subjected to de-coring, forming a first end of the hammer;
- a measurement circuit for measuring an oscillation frequency of the motion mechanism;
- said measurement circuit comprises:
  - at least one sensor for measuring the oscillation frequency of the motion mechanism;
  - a processing circuit, enclosed in a protection casing, for receiving electric signals transmitted by said at least one sensor; and
  - a communication line for conducting electric signals from and/or to said measurement circuit;
  - said jacket comprises a housing formed in an outer surface of the jacket, such that the housing is shaped to incorporate the protection casing of the measurement circuit, and to maintain the protection casing of the measurement circuit within an outer profile of the jacket.

2. The hammer according to claim 1, wherein said housing is formed in a portion of the jacket from which a connection flange extends.

3. The hammer according to claim 2, wherein said housing is formed in a flat initial portion of the connection flange, where the flange begins to emerge from the profile of the jacket.

4. The hammer according to claim 1, wherein said housing comprises at least one connection portion for connecting the measurement circuit to the hammer.

5. The hammer according to claim 1, wherein, at said housing, the jacket comprises a measurement duct through which the measurement circuit can take a measurement for determining the oscillation frequency of the motion mechanism.

6. The hammer according to claim 1, wherein, at said housing, the jacket comprises a channel through which the communication line can be laid.

7. The hammer according to claim 1, wherein a shape of said housing is complementary to a shape of said protection casing of the measurement circuit.

8. The hammer according to claim 1, wherein said housing has a shape suitable for receiving a parallelepiped protection casing, enveloping at least five faces of the protection casing of the measurement circuit.

* * * * *